United States Patent [19]

Vetten

[11] 3,998,378

[45] Dec. 21, 1976

[54] FOLDING BOX HAVING A RECTANGULAR LIQUID-TIGHT CEMENTED BOTTOM

[75] Inventor: Wilhelm Vetten, Dusseldorf, Germany

[73] Assignee: Jagenberg Werke AG, Dusseldorf, Germany

[22] Filed: Mar. 24, 1976

[21] Appl. No.: 669,799

[30] Foreign Application Priority Data

May 7, 1975 Germany ..... 2520401

[52] U.S. Cl. ..... 229/3.1; 229/17 R

[51] Int. Cl.[2] ..... B65D 5/06

[58] Field of Search ..... 229/3.1, 17 R, 8, 41 C

[56] References Cited

UNITED STATES PATENTS

| | | | |
|---|---|---|---|
| 2,032,343 | 3/1976 | Arthur | 229/3.1 X |
| 2,135,855 | 11/1938 | Snyder | 229/17 R X |
| 3,066,844 | 12/1962 | Moore | 229/3.1 X |
| 3,147,904 | 9/1964 | Larson | 229/17 R |
| 3,232,516 | 2/1966 | Arslanian | 229/3.1 X |
| 3,421,678 | 1/1969 | Thompson et al. | 229/3.1 |
| 3,715,576 | 1/1973 | Goebel | 229/8 X |
| 3,827,623 | 8/1974 | Arneson | 229/41 C X |

FOREIGN PATENTS OR APPLICATIONS

| | | | |
|---|---|---|---|
| 505,526 | 5/1939 | United Kingdom | 229/14 C |

OTHER PUBLICATIONS

B 461,257, Jan. 1976, Larson et al., 229/DIG. 4.

*Primary Examiner*—Davis T. Moorhead
*Attorney, Agent, or Firm*—Burgess, Dinklage & Sprung

[57] ABSTRACT

A folding box having a liquid-tight sealed bottom of substantially rectangular configuration, the bottom being formed of first and second facing pairs of panels of the end section of the box wall which end section is not slit about its entire periphery, the pairs of panels being folded down on one another at 90° to the longitudinal axis of the box, the first pair of panels each including a triangular area and two additional areas forming a folding pocket with the two additional areas lying over the triangular area, a fillet seam lying flat along the box bottom and formed of a narrow strip about the entire end section of the box wall, the central area of the bottom being arched toward the inside of the box, the box including a pair of parallel ridges at the sides of the bottom defining the second pair of panels, the ridges being elevated relative to the bottom in inverted position and tapering toward the first pair of panels. The invention also extends to a blank for forming such box, provided with suitable score lines.

2 Claims, 3 Drawing Figures

FOLDING BOX HAVING A RECTANGULAR LIQUID-TIGHT CEMENTED BOTTOM

BACKGROUND

The invention relates to a folding box, especially of oblong rectangular shape, having a rectangular, liquid-tight, sealed bottom formed by two pairs of confronting panels of the unslitted bottom portion of the box which are folded over at 90° to the long axis of said box, two such confronting panels being plain panels and the other two forming each a triangular fold pocket which is laid beneath the plain panels, a narrow strip of the entire end margin of the box being folded together to form a fillet seam which is flattened against the folded sections.

In a folding box of this kind, the bottom is pressed in a die which is flat except for recesses of varying depth corresponding to the number of plies in the various areas of the bottom. With a die of this kind it is possible to apply a uniform pressure over the entire bottom area, which is necessary to prevent the folded bottom material from breaking along the creases.

A box which will be absolutely liquid-tight on the interior without pockets into which the liquid can penetrate can be produced in the above-described box when the bottom is pressed, simply by coating with a thermoplastic adhesive at least the inside of the end section of the box from which the bottom is formed. Before pressing, a box thus prepared is heated with hot air. In the die the thermoplastic adhesive cools, cementing together the superimposed areas of the bottom and sealing the seams.

It has been found to be disadvantageous that a box bottom which has been pressed in a flat die does not have very great stability because the bottom tends to bulge. Attempts to dish the bottom inwardly to create a circumferential edge to provide stability have encountered difficulty in avoiding leakage.

THE INVENTION

The invention is addressed to the problem of creating a folding box having a liquid-tight, cemented bottom and improved stability.

This problem is solved by the invention, in a folding box of the kind initially described, in that the middle part of the bottom is arched toward the interior of the box, while only the two opposite edges of the bottom, which are formed by the folding down of the plain panels, are formed into ridges superelevated above the middle portion of the bottom and tapering towards the other two bottom edges. A bottom of this kind gives the initially described box a stable stance and is absolutely liquid-tight. Even after the liquid has been poured in there is no longer any danger, due to the arching of the bottom that the bottom will bulge out and make the box unstable. Simple dies can be used for the bottom if the arched part of the bottom is composed of three adjacent panels of which the middle panel is perpendicular to the long axis of the box and the two panels on the opposite sides of the middle panel are at an angle to said long axis.

Figure 1:
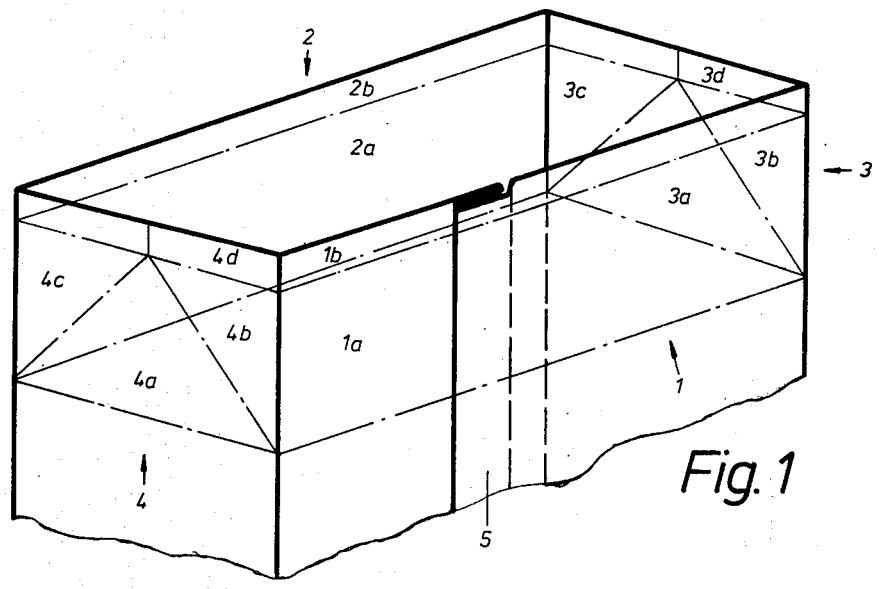
Figure 3:
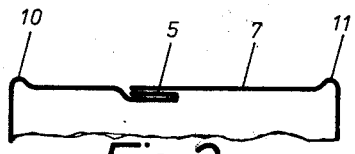
Figure 2:
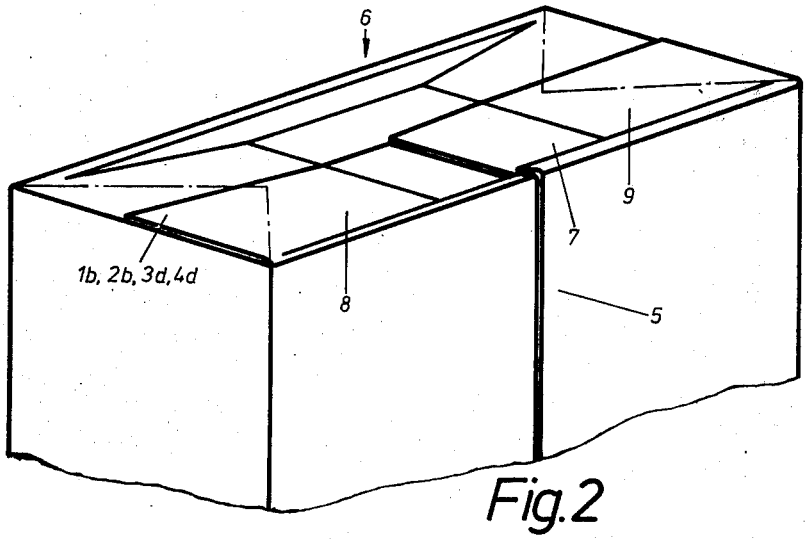

The invention will be further described with reference to the accompanying drawing wherein:

FIG. 1 is an isometric representation of the inverted bottom section, prior to folding, of a folding box provided with creases for the formation of the bottom, FIG. 2 is an isometric representation of the folding box of FIG. 1 after the bottom has been folded and pressed, and FIG. 3 is a cross-sectional view taken through the bottom section of the inverted folding box of FIG. 2.

The bottom section of a folding box of FIG. 1 is composed of two pairs of confronting panels 1–2 and 3–4. The confronting panels 1 and 2 are formed of larger rectangular areas 1*a* and 2*a*, and narrow, rectangular areas 1*b* and 2*b*. The other two confronting panels 3 and 4 are formed of central, triangular areas 3*a* and 4*a*, and the additional triangular areas 3*b*–3*c* and 4*b*–4*c*, and narrow marginal areas 3*d* and 4*d*. The bottom section which is formed by the panels 1*a* to 4*d* has no slits anywhere on its periphery. A cemented seam 5 extends parallel to the long axis of the box, approximately in the center of panel 1.

The bottom 6, as shown in FIG. 2, is formed by folding the bottom section. The triangular panels 3*a* and 4*a* are first folded inwardly so that their apexes point toward the center and the panels 3*b*, 3*c*, 4*b* and 4*c* will be laid on the outer side of panels 3*a* and 4*a*. Panels 3 and 4 are overlapped by the end portions of panels 1*a* and 2*a*. The marginal strips 1*b*, 2*b*, 3*d*, 4*d* are formed, by the folding of portions 3*d* and 4*d*, into a fillet seam which is folded down toward the side opposite seam 5. The bottom 6, folded in this manner, with its thermoplastic coating heated to the welding temperature, is then pressed in a die set composed of an inside die and an outside die such that the superimposed areas are welded together.

In the pressing operation, ridges 10 and 11, which are superelevated in relation to the central bottom panels 7, 8 and 9, are formed at the creases at which panels 1*a* and 2*a* were folded down, and taper towards the creases at which panels 3*a* and 4*a* were turned down, such that they terminate short of these creases. The center panel 7 of the arched bottom area is of flat construction and is perpendicular to the long axis of the box, while the two adjacent and also flat panels 8 and 9 are at an angle thereto.

The bottom formed in this manner gives the box on the one hand a high standing stability, and on the other hand it creates no liquid-tightness problems in the formation of the arch. Since the bottom is arched rather than domed or cupped, there is no danger that the arch will become everted after the box has been filled with the liquid—milk in this case—and destroy the standing stability of the box. To achieve adequate stability the arching needs only to be slight. The deepest area 7, in the case of a box having a bottom measuring 55 × 95 mm, is recessed only by about 2 mm.

The invention also extends to a blank provided with appropriate score lines to form the illustrated box bottom.

It will be appreciated that the instant specification and examples are set forth by way of illustration and not limitation, and that various modifications and changes may be made without departing from the spirit and scope of the present invention.

What is claimed is:

1. A folding box having a liquid-tight sealed bottom of substantially rectangular configuration, the bottom being formed of first and second facing pairs of panels of the end section of the box wall which end section is not slit about its entire periphery, the pairs of panels being folded down on one another at 90° to the longitudinal axis of the box, the first pair of panels each including a triangular area and two additional areas forming a folding pocket with the two additional areas lying over the triangular area, a fillet seam lying flat along the box bottom and formed of a narrow strip about the entire end section of the box wall, the central area of the bottom being arched toward the inside of the box, the box including a pair of parallel ridges at the sides of the bottom defining the second pair of panels, the ridges being elevated relative to the bottom in inverted position and tapering toward the first pair of panels.

2. A folding box according to claim 1, the recessed bottom including a horizontal central portion and two lateral inclined portions adjoining said central portion.

* * * * *